US010400781B2

(12) United States Patent
Nakagawa

(10) Patent No.: US 10,400,781 B2
(45) Date of Patent: Sep. 3, 2019

(54) TURBO FAN AND AIR CONDITIONER HAVING THE SAME

(71) Applicant: SAMSUNG ELECTRONICS CO., LTD., Suwon-si, Gyeonggi-do (KR)

(72) Inventor: Suguru Nakagawa, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 568 days.

(21) Appl. No.: 15/167,077

(22) Filed: May 27, 2016

(65) Prior Publication Data

US 2016/0356284 A1 Dec. 8, 2016

(30) Foreign Application Priority Data

Jun. 3, 2015 (JP) ..... 2015-0112862
May 12, 2016 (KR) ..... 10-2016-0058135

(51) Int. Cl.
*F04D 29/28* (2006.01)
*F04D 29/30* (2006.01)

(52) U.S. Cl.
CPC ..... *F04D 29/281* (2013.01); *F04D 29/30* (2013.01)

(58) Field of Classification Search
CPC ..... F04D 29/30; F04D 29/281; F04D 29/282
See application file for complete search history.

(56) References Cited

U.S. PATENT DOCUMENTS 1,150,278 A * 8/1915 Lepley ..... F04D 29/281 416/183
1,447,915 A * 3/1923 Watkins ..... F04D 29/288 123/41.65
3,201,032 A * 8/1965 Gelbard ..... F04D 29/4253 415/217.1

(Continued)

FOREIGN PATENT DOCUMENTS

EP 2426362 3/2012
EP 2835539 2/2015

(Continued)

OTHER PUBLICATIONS

Extended European Search Report dated Jan. 26, 2018 in European Patent Application No. 16803726.5.

(Continued)

*Primary Examiner* — Woody A Lee, Jr.
(74) *Attorney, Agent, or Firm* — Staas & Halsey LLP

(57) ABSTRACT

Disclosed herein are a turbo fan, which is capable of implementing high efficiency of ventilation and reducing noise by providing a bended portion being bended in a reverse direction against a rotational direction of a wing between a leading edge and a tailing edge thereof to reattach an air separation generated at a negative pressure surface of the wing, and an air conditioner having the same. The air conditioner includes the turbo fan, wherein the turbo fan includes a main plate having a disc shape and on which a rotational shaft is mounted, a side plate provided to be separated from the main plate along an axial direction of the rotational shaft and having a ring shape in which an opening is provided at a center portion of the side plate, and a wing fixed between the main plate and the side plate and provided in plural numbers along a circumferential direction of the main plate, and wherein a bended portion, which is bended in a reverse direction against a rotational direction of the wing, is provided at the wing between a portion of a leading edge of the wing coming in contact with the side plate and a tailing edge of the wing.

20 Claims, 12 Drawing Sheets

(56) References Cited

U.S. PATENT DOCUMENTS

| | | | | | |
|---|---|---|---|---|---|
| 3,221,398 | A * | 12/1965 | Mayne | B21D 53/267 | 29/889.4 |
| 3,260,443 | A * | 7/1966 | Garnett | F01D 5/048 | 29/889.4 |
| 4,231,706 | A * | 11/1980 | Ueda | F04D 29/281 | 416/186 R |
| 4,521,154 | A * | 6/1985 | Corbett | F04D 29/281 | 416/175 |
| 4,647,271 | A * | 3/1987 | Nagai | F04D 29/281 | 416/186 R |
| 5,667,360 | A * | 9/1997 | Hauser | F04D 29/023 | 416/183 |
| 8,668,460 | B2 * | 3/2014 | Han | F04D 29/30 | 416/223 A |

FOREIGN PATENT DOCUMENTS

| | | |
|---|---|---|
| JP | 2005-282567 | 10/2005 |
| JP | 2010-174671 | 8/2010 |
| JP | 2014-190309 | 10/2014 |
| KR | 20-0319016 | 7/2003 |
| KR | 10-2005 0119071 A | 12/2005 |
| KR | 10-2006-0086729 | 8/2006 |
| KR | 10-2010-0134011 A | 12/2010 |
| KR | 10-2012-0023319 A | 3/2012 |
| KR | 10-2014-0123332 A | 10/2014 |

OTHER PUBLICATIONS

Form PCT/ISA/210; International Search Report dated Aug. 24, 2016 in corresponding International Patent Application No. PCT/KR2016/005792 (3 pages).

European Communication dated Nov. 2, 2018 in European Patent Application No. 16803726.5.

Chinese Office Action dated May 8, 2019 in Chinese Patent Application No. 201680015421.9.

* cited by examiner

TURBO FAN AND AIR CONDITIONER HAVING THE SAME

CROSS-REFERENCE TO RELATED APPLICATION

This application claims the benefit of Japan Patent Application No. 2015-112862, filed on Jun. 3, 2015 in the Japan Patent Office and Korean Patent Application No. 10-2016-0058135, filed on May 12, 2016 in the Korean Intellectual Property Office, the disclosure of which is incorporated herein by reference.

BACKGROUND

1. Field

Embodiments of the present disclosure relate to a turbo fan and an air conditioner having the same.

2. Description of the Related Art

Generally, a turbo fan is used in a ventilation device including an air conditioner and the like, and includes a main plate of a disc shape mounted at a rotational shaft of a motor, a side plate provided to be spaced apart from the main plate in an axial direction of the rotational shaft, and a plurality of wings fixed between the main plate and the side plate and provided in a circumferential direction of the main plate.

An opening for suctioning air is provided at a center portion of the side plate, and air suctioned through the opening is discharged through an empty area between the side plate and the main plate.

For the purpose of high efficiency and low noise of ventilation, each wing of the turbo fan is bended in a reverse direction against a rotational direction of the wing in an outermost diameter direction of a leading edge thereof, and such a bended shape may promote a reattachment of an air separation (escape) which occurs at a negative pressure surface.

It has been known that an air separation occurring at a negative pressure surface is easily generated at a contact portion between the side plate and a leading edge of each wing because air suctioned through the opening of the side plate is greatly turned at the contact portion to cause a highly unstable flow of the air.

However, since a bended portion of each wing of the turbo fan is located at the contact portion between the side plate and the leading edge of each wing and each wing is not bended toward a downstream side from the contact portion, there is a problem in which an air separation occurring at the contact portion between the side plate and the leading edge of each wing is not reattached.

SUMMARY

Therefore, it is an aspect of the present disclosure to provide a turbo fan capable of implementing high efficiency of ventilation and reducing noise thereof by providing a bended portion being bended in a reverse direction against a rotational direction of a wing between a leading edge and a tailing edge thereof to reattach an air separation generated at a negative pressure surface of the wing, and a ventilation device having the same.

In accordance with one embodiment of the present disclosure, an air conditioner includes a turbo fan including, a main plate having a disc shape and on which a rotational shaft is mounted, a side plate provided to be separated from the main plate along an axial direction of the rotational shaft and having a ring shape with an opening at a center portion of the side plate, and a plurality of wings fixed between the main plate and the side plate along a circumferential direction of the main plate, wherein each wing of the plurality of wings includes a leading edge having a portion coming in contact with the side plate, a trailing edge, and a bended portion, which is bended in a reverse direction against a rotational direction of the wing between the portion of the leading edge of the wing coming in contact with the side plate and the tailing edge of the wing.

For each wing of the plurality of wings, the leading edge has a main plate contact portion at which the leading edge and the main plate come in contact with each other, the main plate contact portion having a first curved shape in which a first curvature variation is small, the leading edge has a side plate contact portion at which the leading edge and the side plate come in contact with each other, the side plate contact portion having a second curved shape in which a second curvature variation is small, and the bended portion may be between the main plate contact portion and the side plate contact portion.

For each wing of the plurality of wings, the tailing edge may be provided to have a straight line shape inclined toward an axial direction of the turbo fan, or a curve shape waved in an axial direction.

A hub at which the rotational shaft is mounted may be provided at the main plate, and the main plate and the side plate may be molded with a resin material.

Air may be suctioned through the opening provided in the side plate, and the air suctioned through the opening may be discharged through an empty area between the side plate and the main plate.

The side plate may be provided to have an outer diameter equal to that of the main plate, and to have a shape of which an inner diameter is decreased as it goes toward an inner side in a direction away from the main plate.

Each wing of the plurality of wings may be configured to have a convexly curved shape in the rotational direction of the wing, and to include a positive pressure surface which is an outer circumferential surface in the rotational direction of the wing and a negative pressure surface which is a rear surface opposite to the positive pressure surface.

The main plate may include a faceplate part facing the side plate, and the leading edge and the tailing edge of each wing of the plurality of wings may be formed from the faceplate part to an inner circumferential surface of the side plate.

For each wing of the plurality of wings, a distance between a main plate contact portion at which the leading edge and the main plate come in contact with each other and the rotational shaft may be less than a radius of the opening, and a distance between a side plate contact portion at which the leading edge and the side plate come in contact with each other and the rotational shaft may be greater than the radius of the opening.

For each wing of the plurality of wings, the tailing edge may be fixed to an outer edge portion of the main plate and an outer edge portion of the side plate.

For each wing of the plurality of wings, the main plate contact portion and the side plate contact portion may be provided to have a curved shape having no bended portion, and the bended portion may be provided between the main plate contact portion and the side plate contact portion.

For each wing of the plurality of wings, each of the positive pressure surface of the wing and the negative pressure surface thereof may be bended in a reverse direction against the rotational direction of the wing at the bended portion.

For each wing of the plurality of wings, the positive pressure surface and the negative pressure surface may be provided to have a front end bending modulus being constant from the leading edge to the bended portion and a rear end bending modulus being constant from the bended portion to the tailing edge, and the front end bending modulus and the rear end bending modulus may be provided to have bending moduli different from each other.

For each wing of the plurality of wings, the positive pressure surface and the negative pressure surface may be provided to have a front end bending modulus being continuously varied from the leading edge to the bended portion and a rear end bending modulus being continuously varied from the bended portion to the tailing edge, and the front end bending modulus and the rear end bending modulus may be provided to have bending moduli different from each other.

For each wing of the plurality of wings, when a separation distance between outer edges of the main plate and the side plate along a direction of the rotational shaft is h0 and a height of the wing from the main plate along the direction of the rotational shaft is h1, the wing may be bended in the reverse direction against the rotational direction of the wing in a range of the height h1 satisfying $0.2 \leq h1/h0 \leq 8$.

For each wing of the plurality of wings, a diameter direction length Ra from the rotational shaft to the leading edge, a diameter direction length Rb from the rotational shaft to the tailing edge, and a diameter direction length Rc from the rotational shaft to the bended portion may satisfy $0.3 \leq (Rc-Ra)/(Rb-Ra) \leq 0.7$.

For each wing of the plurality of wings, a wing angle $\beta a$ formed between an extended direction of the wing at the leading edge and a tangential direction of a rotational orbit of the leading edge, and a wing angle $\beta c$ formed between an extended direction of the wing at the bended portion and a tangential direction of a rotational orbit of the bended portion may satisfy $0.6 \leq \beta c/\beta a \leq 0.9$.

Also, in accordance with one embodiment of the present disclosure, a ventilation device includes a turbo fan including, a main plate having a disc shape and on which a rotational shaft is mounted, a side plate provided to be separated from the main plate along an axial direction of the rotational shaft and having a ring shape with an opening at a center portion of the side plate, and a plurality of wings fixed between the main plate and the side plate along a circumferential direction of the main plate, wherein each wing of the plurality of wings includes a leading edge having a portion coming in contact with the side plate, a trailing edge, and a bended portion, which is bended in a reverse direction against a rotational direction of the wing between the portion of the leading edge of the wing coming in contact with the side plate and the tailing edge of the wing.

For each wing of the plurality of wings, the leading edge has a main plate contact portion at which the leading edge and the main plate come in contact with each other, the main plate contact portion having a first curved shape in which a first curvature variation is small, the leading edge has a side plate contact portion at which the leading edge and the side plate come in contact with each other, the side plate contact portion having a second curved shape in which a second curvature variation is small, and the bended portion may be between the main plate contact portion and the side plate contact portion.

Additionally, in accordance with one embodiment of the present disclosure, a turbo fan includes a main plate having a disc shape and on which a rotational shaft is mounted, a side plate provided to be separated from the main plate along an axial direction of the rotational shaft and having a ring shape with an opening at a center portion of the side plate, and a plurality of wings fixed between the main plate and the side plate along a circumferential direction of the main plate, wherein each wing of the plurality of wings includes a leading edge having a portion coming in contact with the side plate, a trailing edge, and a bended portion, which is bended in a reverse direction against a rotational direction of the wing between the portion of the leading edge of the wing coming in contact with the side plate and the tailing edge of the wing.

For each wing of the plurality of wings, the leading edge has a main plate contact portion at which the leading edge and the main plate come in contact with each other, the main plate contact portion having a first curved shape in which a first curvature variation is small, the leading edge has a side plate contact portion at which the leading edge and the side plate come in contact with each other, the side plate contact portion having a second curved shape in which a second curvature variation is small, and the bended portion is between the main plate contact portion and side plate contact portion.

In accordance with the embodiments of the present disclosure, high efficiency of ventilation and low noise may be implemented and work efficiency at the positive pressure surface of the wing may be improved.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, one embodiment of a turbo fan provided in an air conditioner according to the present disclosure will be described with reference to the accompanying drawings.

Figure 1:
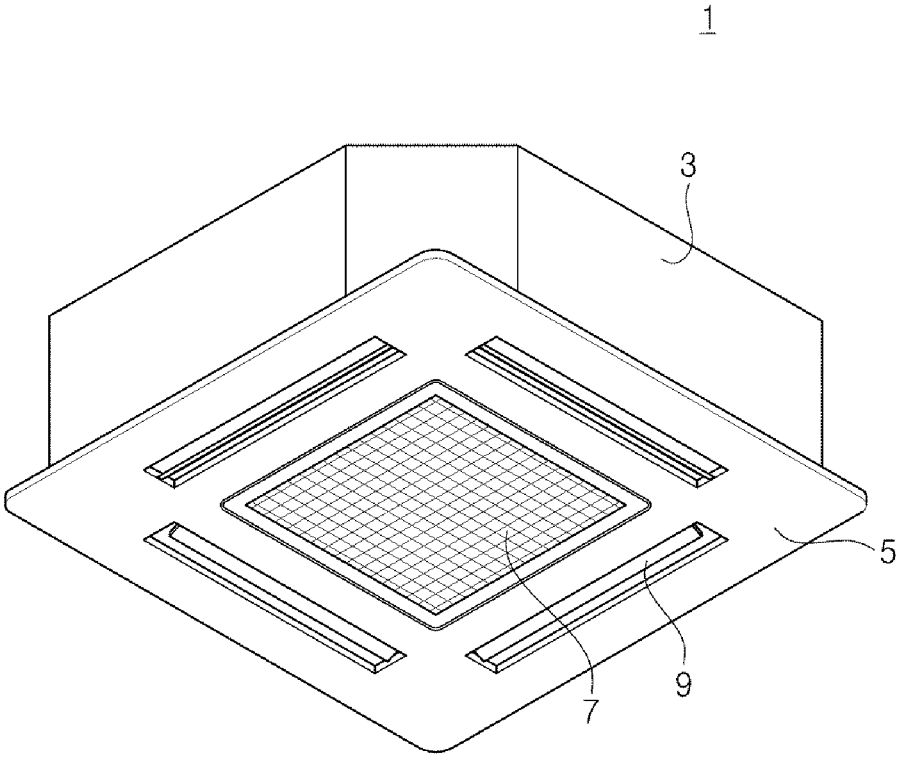
FIG. 1 is a perspective view illustrating an air conditioner according to one embodiment of the present disclosure.
Figure 2:
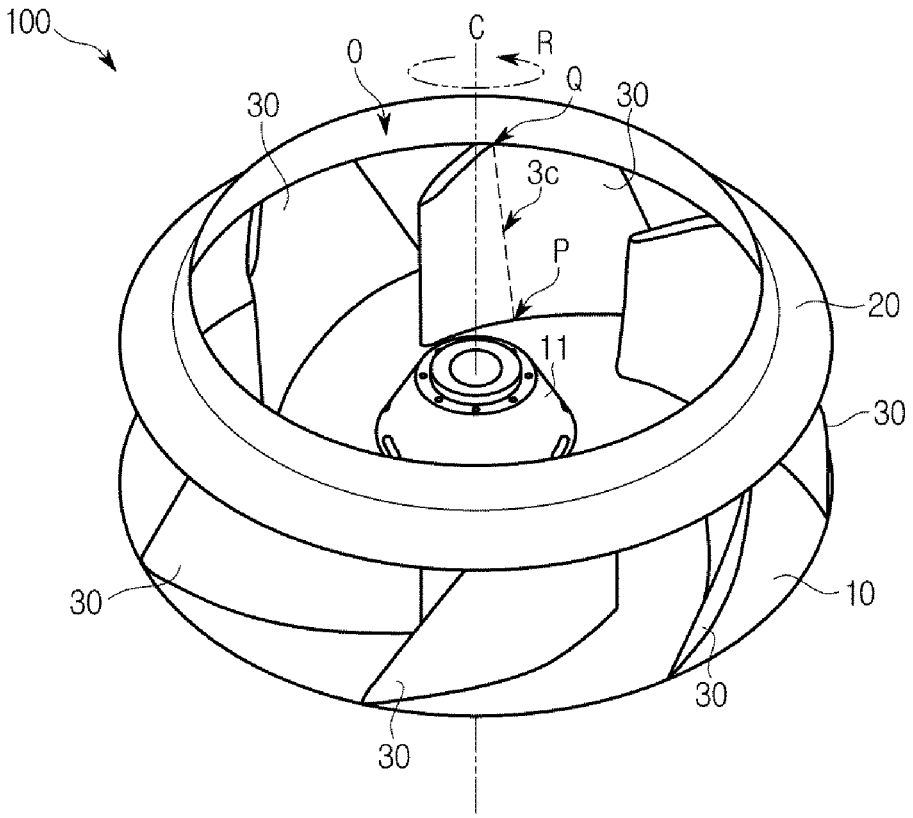
FIG. 2 is a perspective view schematically illustrating a turbo fan according to one embodiment of the present disclosure.

A turbo fan 100 according to the present embodiment is used in a ventilation device, for example, an air conditioner 1 and the like. As shown in FIGS. 1 and 2, the air conditioner 1 is fit in and installed on a ceiling (not shown) through an opening thereof, and includes a main body 3 of a polyhedral box shape of which a lower surface is opened, and a ceiling panel 5 mounted at a lower end of the main body 3.

The turbo fan 100 is provided inside the main body 3, a suction inlet 7 through which outside air is suctioned is provided at a center portion of the ceiling panel 5, and a discharge outlet 9 through which air is discharged is provided at outer side peripheries of the suction inlet 7.

The turbo fan 100 includes a main plate 10 of a disc shape at which a rotational shaft C of a motor (not shown) is mounted, a side plate 20 provided in a ring shape when viewed from a plane at an opposite position spaced apart from the main plate 10 toward an axial direction of the rotational shaft C, and a plurality of wings 30 provided between the main plate 10 and the side plate 20 to be fixed therebetween.

With such a configuration, the main plate 10, the side plate 20, and each of the wings 30 of the turbo fan 100 are integrally rotated around the rotational shaft C, and the turbo fan 100 suctions air along the axial direction through an opening O formed at the side plate 20 and discharges the suctioned air along a diameter direction between the main plate 10 and the side plate 20.

The main plate 10 has a hub that is a fixing unit 11 at which the rotational shaft C of the motor is mounted, and may be configured with, for example, a resin product fabricated to align a central axis of the hub with the rotational shaft C.

The side plate 20 is a so-called shroud (a cover ring) in which the opening O formed at the center portion thereof is provided as the suction inlet for suctioning air, and an empty area between outer edges of the side plate 20 and the main plate 10 is provided as the discharge outlet.

The side plate 20 of the present embodiment may be configured with, for example, a resin product which is set to have an outer diameter the same as that of the main plate 10, has a shape bended in a direction away from the main plate 10 and an inner diameter which is decreased as it goes toward an inner side of the resin product, and is fabricated to align a center axis of the side plate 20 with the rotational shaft C.

Also, the side plate 20 is not limited to the shape described above, and it may be a flat plate of a ring shape when viewed from the plane, for example.

As shown in FIGS. 2 to 5, the wing 30 is configured to be rotated around the rotational shaft C and also to have a convexly curved shape to a rotational direction R of the wing 30 to extrude air from a positive pressure surface 31, which is an outer circumferential surface of the rotational direction R, toward the diameter direction.

Also, each of the positive pressure surface 31 and a negative pressure surface 32 is herein convexly curved to the rotational direction R.

The turbo fan 100 of the present embodiment includes a plurality of wings 30, for example, resin products, having a shape the same as each other, and each of the wings 30 is arranged along a circumferential direction in a regular interval centering on the rotational shaft C and also is fixed to the main plate 10 and the side plate 20 through, for example, laser fusion.

A leading edge 3*a* and a tailing edge 3*b* of each wing 30 are formed from a faceplate part 12 of the main plate 10 facing the side plate 20 to an inner circumferential surface 21 thereof.

In particular, when viewed from the plane, a part of the leading edge 3*a* is installed at an inner side as compared to the opening O of the side plate 20, and in the present embodiment, a main plate contact portion P, which is a contact portion of the leading edge 3*a* and the main plate 10, is located at an inner side as compared to the opening O, and also a side plate contact portion Q, which is a contact portion of the leading edge 3*a* and the side plate 20, is located at an outer side as compared to the opening O.

Also, when viewed from the plane, the tailing edge 3*b* is installed to be overlapped with the outer edges of the main plate 10 and the side plate 20. That is, the tailing edge 3*b* is fixed to an outer edge portion of the main plate 10 and an outer edge portion of the side plate 20.

However, the wing 30 of the present embodiment is provided to have a shape which is more bended in the reverse direction against the rotational direction R of the wing 30 toward an outer diameter direction as compared to a leading edge outer end 35 of the leading edge 3*a* in an outermost diameter direction.

In other words, each of the wings 30 is provided to have a shape bended in the reverse direction against the rotational direction R thereof between the leading edge 3*a* and the tailing edge 3*b*, and herein is more bended in the reverse direction against the rotational direction R of the wing 30 in the outer diameter direction as compared to the side plate contact portion Q which is the contact portion of the leading edge 3*a* and the side plate 20 as described above.

In particular, each of the wings 30 includes a bended portion 3*c* at which a bending modulus is discontinuously varied between the leading edge 3*a* and the tailing edge 3*b*, and the positive pressure surface 31 and the negative pressure surface 32 are bended at the bended portion 3*c* in the reverse direction against the rotational direction R of each of the wings 30.

Specifically, the positive pressure surface 31 and the negative pressure surface 32 have a front end bending modulus, which is constantly or continuously varied, from the leading edge 3*a* to the bended portion 3*c* and also a rear end bending modulus, which is constantly or continuously varied, from the bended portion 3*c* to the tailing edge 3*b*, and the front end bending modulus and the rear end bending modulus are configured to have bending moduli or variation rates different from each other.

Also, in order to configure each of the wings 30 as described above, a central line (so-called as a camber line) passing center points of the positive pressure surface 31 and the negative pressure surface 32 may be bended in the reverse direction against the rotational direction R of the wing 30 at the bended portion 3*c* to vary a bending modulus of the central line before and after the bended portion 3*c*.

Figure 5:
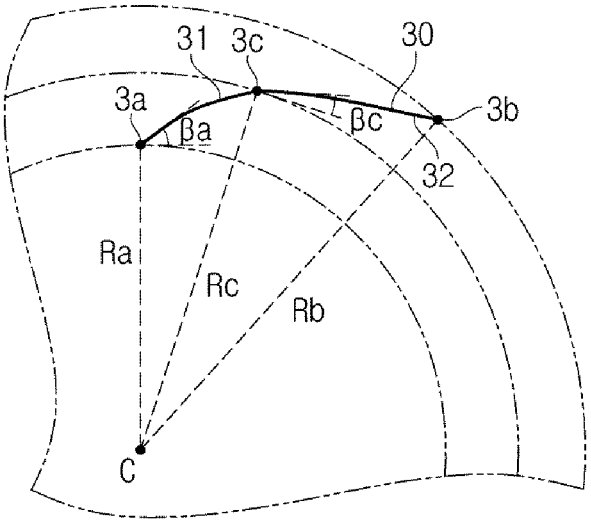
FIG. 5 is a diagram for describing a bended portion provided at a wing of the turbo fan according to one embodiment of the present disclosure.

The bended portion 3*c* is located at the outer diameter direction as compared to the opening O of the side plate 20 when viewed from the plane, and herein, as shown in FIG. 5, when a diameter direction length Ra is a length from the rotational shaft C to the leading edge 3*a*, a diameter direction length Rb is a length from the rotational shaft C to the tailing edge 3*b*, and a diameter direction length Rc is a length from the rotational shaft C to the bended portion 3*c* in a cross section perpendicular to the axial direction, the bended portion 3*c* is installed to satisfy Equation 1 as follows.

$$0.3 \leq (Rc-Ra)/(Rb-Ra) \leq 0.7 \quad \text{Equation 1}$$

Also, in the cross section perpendicular to the axial direction, a wing angle βa and a wing angle βc of each of the wings 30 according to the present embodiment are configured to satisfy Equation 2 as follows, wherein the wing angle βa is an angle formed between an extended direction of the wing 30 at the leading edge 3*a* and a tangential direction of a rotational orbit at the leading edge 3*a*, and the wing angle βc is an angle formed between an extended direction of the wing 30 at the bended portion 3*c* and a tangential direction of a rotational orbit at the bended portion 3*c*.

$$0.6 \leq \beta c/\beta a \leq 0.9 \quad \text{Equation 2}$$

Figure 3:
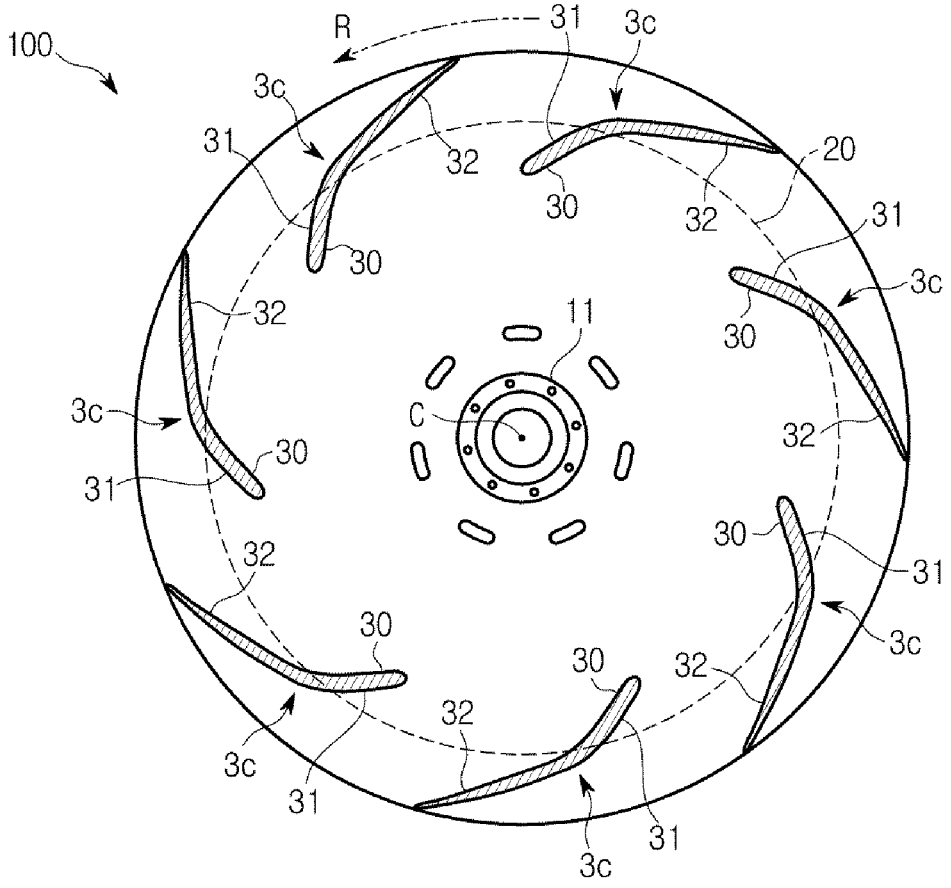
FIG. 3 is a cross-sectional view perpendicular to an axial direction of the turbo fan according to one embodiment of the present disclosure.

Here, as shown in FIG. 3, the bended portion 3*c* described above is formed only between a main plate lateral end 33 of each of the wings 30 and a side plate lateral end 34 thereof instead of being formed at the main plate lateral end 33 and the side plate lateral end 34.

Figure 6:
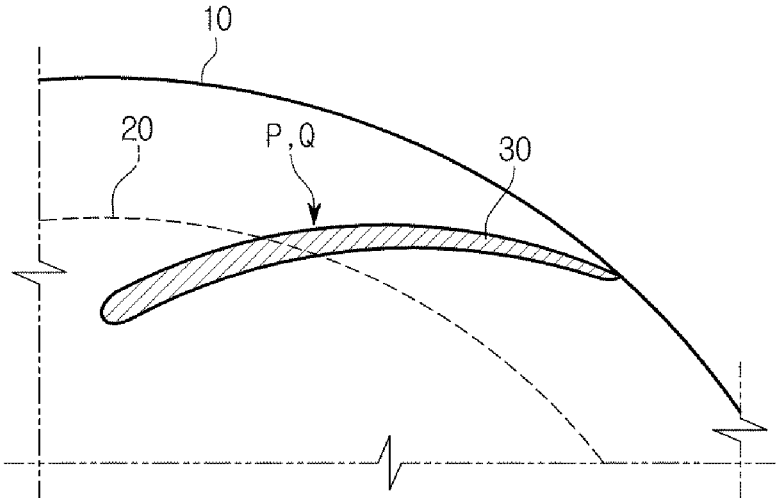
FIG. 6 is a cross-sectional view illustrating a main plate contact portion and a side plate contact portion which are provided at the wing according to one embodiment of the present disclosure.
Figure 7:
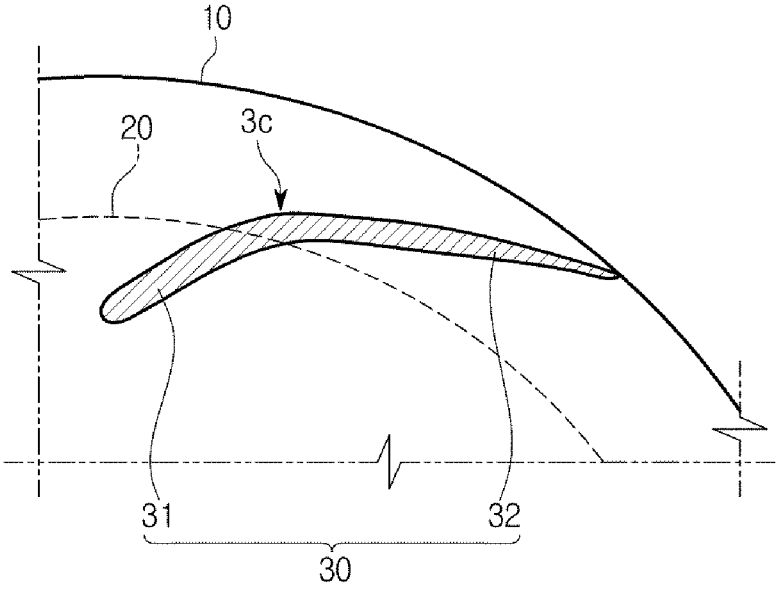
FIG. 7 is a cross-sectional view illustrating the bended portion provided at the wing according to one embodiment of the present disclosure.

That is, as shown in FIGS. 2 and 6, in each of the wings 30 of the present embodiment, the main plate contact portion P coming in contact with the main plate 10 and the side plate contact portion Q coming in contact with the side plate 20 are not bended at all to form a curved shape having a less curvature variation, and, as shown in FIGS. 2 and 7, a predetermined section along the axial direction between the main plate contact portion P and the side plate contact portion Q is provided as the bended portion 3*c* of the bended shape having a large curvature variation in the reverse direction against the rotational direction R of the wing 30.

Figure 4:
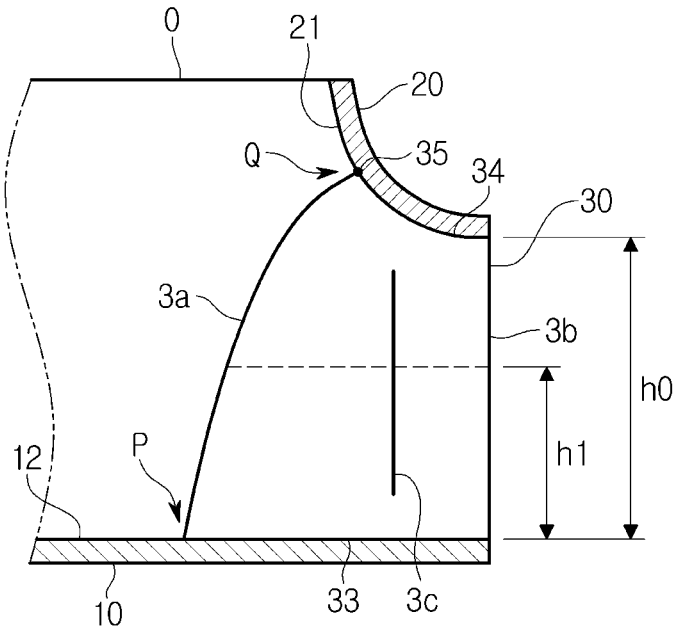
FIG. 4 is a cross-sectional view cutting in the axial direction of the turbo fan according to one embodiment of the present disclosure.

In particular, as shown in FIG. 4, when a separation distance between the outer edges of the main plate 10 and the side plate 20 along the axial direction is h0 and a height length of the wing 30 from the main plate 10 along the axial direction is h1, each of the wings 30 is bended in a reverse direction against a rotational direction in a range of the height length h1 satisfying Equation 3 as follows.

$$0.2 \leq h1/h0 \leq 0.8 \quad \text{[Equation 3]}$$

Figure 8:
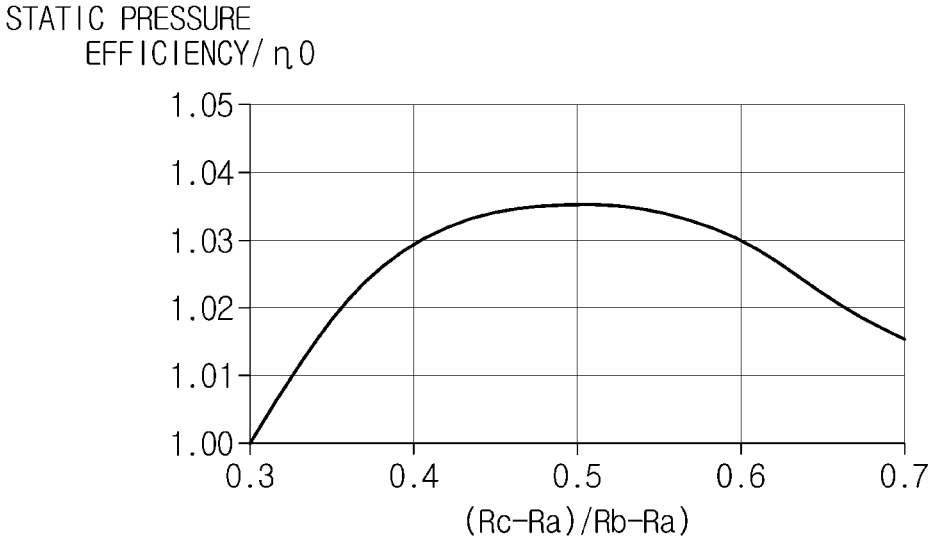
FIGS. 8 and 9 are graphs illustrating effectiveness of the turbo fan according to one embodiment of the present disclosure.

Next, in the turbo fan 100 of the present embodiment, when (Rc−Ra)/(Rb−Ra) is varied in the range of Equation 1 described above, a ratio variation between a static pressure efficiency and a reference static pressure efficiency $\eta_0$ is shown in FIG. 8. Here, a graph shown in FIG. 8 represents a ratio of the static pressure efficiency when the reference static pressure efficiency $\eta_0$ is the static pressure efficiency in a case that (Rc−Ra)/(Rb−Ra) is 0.3.

As shown in the present graph, when (Rc−Ra)/(Rb−Ra) is 0.5 in the range of Equation 1 described above, it can be seen that the static pressure efficiency becomes a maximum.

Figure 9:
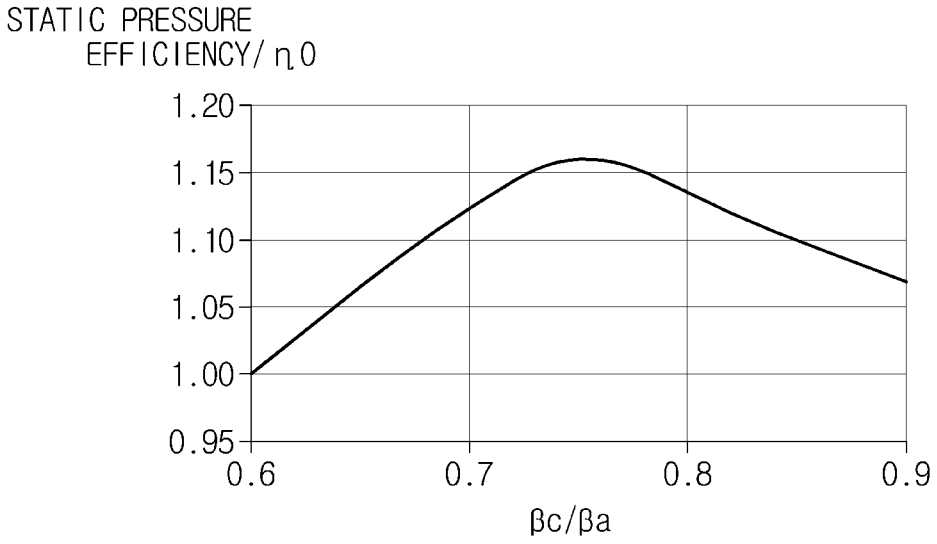

Also, when βc/βa is varied in the range of Equation 2 described above, a ratio variation between a static pressure efficiency and a reference static pressure efficiency $\eta_b$ is shown in FIG. 9. Here, a graph shown in FIG. 9 represents a ratio of the static pressure efficiency when the reference static pressure efficiency $\eta_b$ is the static pressure efficiency in a case that βc/βa is 0.6.

As shown in the present graph, when βc/βa is 0.75 in the range of Equation 2 described above, it can be seen that the static pressure efficiency becomes a maximum. Also, in a case of βc/βa<0.6, an air separation occurs at the positive pressure surface 31 and air flowing toward the diameter direction comes in contact from the bended portion 3*c* to the tailing edge 3*b*, so that this contact portion from the bended portion 3*c* to the tailing edge 3*b* serves as resistance. Moreover, in a case of βc/βa>0.9, a load of the positive pressure surface 31 of the bended portion 3*c* at the leading edge 3*a* could not be increased so that ventilation efficiency may not be improved.

Figure 10:
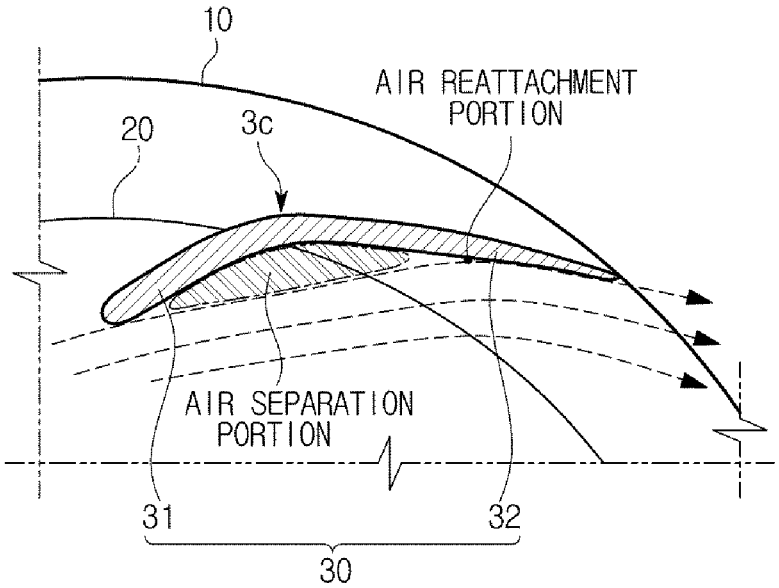
FIG. 10 is a diagram for describing an air separation portion and an air reattachment portion at the wing according to one embodiment of the present disclosure.

With such a turbo fan 100 configured according to the present embodiment, each of the wings 30 has been more bended in the reverse direction against the rotational direction R of the wing 30 toward the outer diameter direction as compared to the leading edge outer end of the leading edge 3*a* located in the outermost diameter direction, and the bended portion 3*c* is located more outward in the outer diameter direction as compared to the side plate contact portion Q at which the leading edge 3*a* and the side plate 20 come in contact with each other, so that, as shown in FIG. 10, air may be reattached at the negative pressure surface 32 to a downstream side as compared to the bended portion 3*c* of each of the wings 30 to implement high efficiency and low noise of ventilation.

In addition, each of the negative pressure surface 32 of the wing 30 and the positive pressure surface 31 thereof is more bended in the reverse direction toward the outer diameter direction as compared to the leading edge outer end 35, so that the air being separated is reattached to the negative pressure surface 32 of the wing 30 and also a boost performance at the positive pressure surface 31 is improved, thereby improving work efficiency of each of the wings 30.

Also, the main plate lateral end 33 and the side plate lateral end 34 of each of the wings 30 are not bended, so that a stress concentration generated at the main plate contact portion P at which each of the wings 30 and the main plate 10 come in contact with each other or the side plate contact portion Q at which each of the wings 30 and the side plate 20 come in contact with each other may be reduced and a mechanical strength of the turbo fan 100 with respect to a centrifugal force may be secured upon being rotated.

In addition, the main plate 10, the side plate 20, and each of the wings 30 are the resin products so that a weight of turbo fan 100 may be lightened.

Figure 11:
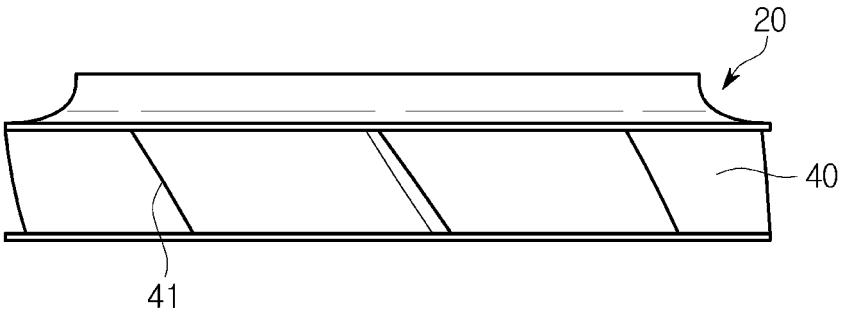
FIGS. 11 and 12 are diagrams illustrating a turbo fan according to another embodiment of the present disclosure.
Figure 12:
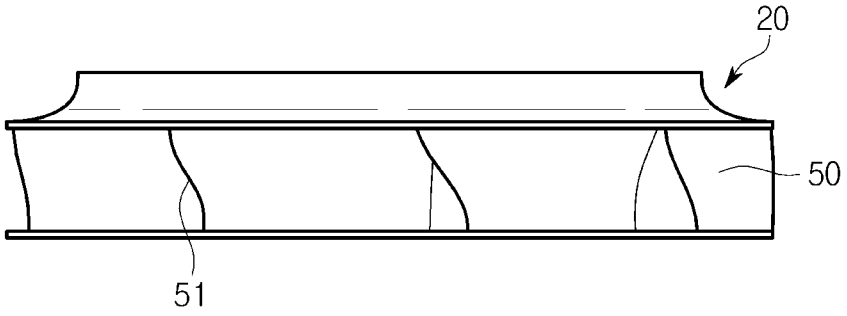

As shown in FIG. 11, a tailing edge 41 of a wing 40 may be provided to have a straight line shape inclined toward an axial direction, or, as shown in FIG. 12, a tailing edge 51 of a wing 50 may be provided to have a curve shape waved in an axial direction.

The wings 40 and 50 shown in FIGS. 11 and 12 are adjustable in a wind direction according to a specification of the turbo fan 100, and are the same as the wing 30 shown in FIG. 2 except the shape of the tailing edge 3*b* thereof and also have effectiveness identical to that of the wing 30.

In addition, the present disclosure is not limited to the embodiments described above.

For example, in the wing 30 of the embodiment described above, although the main plate contact portion P at which the leading edge 3*a* and the main plate 10 come in contact with each other is installed at the inner side as compared to the opening O of the side plate 20 when viewed from the plane, it may be installed to be located at an outer side as compared to the opening O of the side plate 20 when viewed from the plane.

Also, in the wing 30 of the embodiment described above, although the side plate contact portion Q at which the leading edge 3*a* and the side plate 20 come in contact with each other is installed at the outer side as compared to the opening O of the side plate 20 when viewed from the plane, the leading edge 3*a* may come in contact with an inner edge portion of the side plate 20.

Additionally, in the wing 30 of the embodiment described above, although the tailing edge 3*b* is installed to be overlapped with the outer edges of the main plate 10 and the side plate 20, a part or all of the tailing edge 3*b* may be installed to be located at the inner side as compared to the outer edges of the main plate 10 and the side plate 20.

Moreover, in the embodiments described above, although the outer diameter of the main plate 10 and the outer diameter of the side plate 20 are set as the same size, they may be set as sizes different from each other.

Furthermore, in the embodiments described above, although the main plate 10, the side plate 20, and each of the wings 30 are the resin products, a material thereof may be changed to various materials, for example, metal and the like.

Although the present disclosure has been described above with reference to the accompanying drawings by focusing on "the turbo fan and the ventilation device having the same" having a specific shape and direction, numerous other modifications and alterations can be devised by those skilled in the art and these should be construed as falling within the spirit and scope of the principles of the present invention.

[Description of Reference Numerals]

| | |
|---|---|
| 3a: Leading Edge | 3b: Tailing Edge |
| 3c: Bended Portion | 10: Main Plate |
| 20: Side Plate | 30: Wing |
| 31: Positive Pressure Surface | 32: Negative Pressure Surface |
| 35: Leading Edge Outer End | 100: Turbo Fan |
| O: Opening | R: Rotational Direction |
| P: Main Plate Contact Portion | Q: Side Plate Contact Portion |

What is claimed is:

1. An air conditioner comprising:

a turbo fan including:

a main plate having a disc shape and on which a rotational shaft is mounted;

a side plate provided to be separated from the main plate along an axial direction of the rotational shaft and having a ring shape with an opening at a center portion of the side plate; and a plurality of wings fixed between the main plate and the side plate along a circumferential direction of the main plate, wherein each wing of the plurality of wings includes a leading edge having a portion coming in contact with the side plate, a trailing edge, and a bended portion, which is bended in a reverse direction against a rotational direction of the wing between the portion of the leading edge of the wing coming in contact with the side plate and the trailing edge of the wing, and nearer to the portion of the leading edge of the wing coming into contact with the side plate than to the trailing edge.

2. The air conditioner of claim 1, wherein, for each wing of the plurality of wings:

the wing has a main plate contact portion at which the wing and the main plate initially come in contact with each other in a direction along the wing moving away from the leading edge, the main plate contact portion having a first curved shape having a first curvature variation, the wing has a side plate contact portion at which the wing and the side plate initially come in contact with each other in a direction along the wing moving away from the leading edge, the side plate contact portion having a second curved shape having a second curvature variation, and the bended portion is between the main plate contact portion and the side plate contact portion.

3. The air conditioner of claim 1, wherein, for each wing of the plurality of wings, the trailing edge is provided to have a straight line shape inclined toward an axial direction of the turbo fan, or a curve shape waved in an axial direction.

4. The air conditioner of claim 1, wherein air is suctioned through the opening provided in the side plate, and the air suctioned through the opening is discharged through an empty area between the side plate and the main plate.

5. The air conditioner of claim 4, wherein the side plate is provided to have an outer diameter equal to that of the main plate, and a shape in which an inner diameter is decreased as it goes toward an inner side in a direction away from the main plate.

6. The air conditioner of claim 1, wherein each wing of the plurality of wings is configured to have a convexly curved shape in the rotational direction of the wing, and to include a positive pressure surface which is an outer circumferential surface in the rotational direction of the wing and a negative pressure surface which is a rear surface opposite to the positive pressure surface.

7. The air conditioner of claim 6, wherein the main plate includes a faceplate part facing the side plate, and the leading edge and the trailing edge of each wing of the plurality of wings are formed from the faceplate part to an inner circumferential surface of the side plate.

8. The air conditioner of claim 7, wherein, for each wing of the plurality of wings, a distance between a main plate contact portion at which the leading edge and the main plate come in contact with each other and the rotational shaft is less than a radius of the opening, and a distance between a side plate contact portion at which the leading edge and the side plate come in contact with each other and the rotational shaft is greater than the radius of the opening.

9. The air conditioner of claim 8, wherein, for each wing of the plurality of wings, the trailing edge is fixed to an outer edge portion of the main plate and an outer edge portion of the side plate.

10. The air conditioner of claim 8, wherein, for each wing of the plurality of wings, the main plate contact portion and the side plate contact portion are provided to have a curved shape having no bended portion, and the bended portion is provided between the main plate contact portion and the side plate contact portion.

11. The air conditioner of claim 6, wherein, for each wing of the plurality of wings, each of the positive pressure surface of the wing and the negative pressure surface thereof is bended in a reverse direction against the rotational direction of the wing at the bended portion.

12. The air conditioner of claim 11, wherein, for each wing of the plurality of wings, the positive pressure surface and the negative pressure surface are provided to have a front end bending modulus being constant from the leading edge to the bended portion and a rear end bending modulus being constant from the bended portion to the trailing edge, and the front end bending modulus and the rear end bending modulus are provided to have bending moduli different from each other.

13. The air conditioner of claim 11, wherein, for each wing of the plurality of wings, the positive pressure surface and the negative pressure surface are provided to have a front end bending modulus being continuously varied from the leading edge to the bended portion and a rear end bending modulus being continuously varied from the bended portion to the trailing edge, and the front end bending modulus and the rear end bending modulus are provided to have bending moduli different from each other.

14. The air conditioner of claim 1, wherein, for each wing of the plurality of wings, when a separation distance between outer edges of the main plate and the side plate along a direction of the rotational shaft is h0 and a height of the wing from the main plate along the direction of the rotational shaft is h1, the wing is bended at the bended portion in the reverse direction against the rotational direction of the wing in a range of the height h1 satisfying $0.2 \leq h1/h0 \leq 0.8$.

15. The air conditioner of claim 1, wherein, for each wing of the plurality of wings, a diameter direction length Ra from the rotational shaft to the leading edge, a diameter direction length Rb from the rotational shaft to the trailing edge, and a diameter direction length Rc from the rotational shaft to the bended portion satisfy $0.3 \leq (Rc-Ra)/(Rb-Ra) \leq 0.7$.

16. The air conditioner of claim 1, wherein, for each wing of the plurality of wings, a wing angle βa formed between an extended direction of the wing at the leading edge and a tangential direction of a rotational orbit of the leading edge, and a wing angle βc formed between an extended direction of the wing at the bended portion and a tangential direction of a rotational orbit of the bended portion satisfy $0.6 \leq \beta c/\beta a \leq 0.9$.

17. A ventilation device comprising:

a turbo fan including:

a main plate having a disc shape and on which a rotational shaft is mounted;

a side plate provided to be separated from the main plate along an axial direction of the rotational shaft and having a ring shape with an opening at a center portion of the side plate; and a plurality of wings fixed between the main plate and the side plate along a circumferential direction of the main plate, wherein each wing of the plurality of wings includes a leading edge having a portion coming in contact with the side plate, a trailing edge, and a bended portion, which is bended in a reverse direction against a rotational direction of the wing between the portion of the leading edge of the wing coming in contact with the side plate and the trailing edge of the wing, and nearer to the portion of the leading edge of the wing coming into contact with the side plate than to the trailing edge.

18. The ventilation device of claim 17, wherein, for each wing of the plurality of wings:

the wing has a main plate contact portion at which the wing and the main plate initially come in contact with each other in a direction along the wing moving away from the leading edge, the main plate contact portion having a first curved shape having a first curvature variation, the wing has a side plate contact portion at which the wing and the side plate initially come in contact with each other in a direction along the wing moving away from the leading edge, the side plate contact portion having a second curved shape having a second curvature variation, and the bended portion is between the main plate contact portion and the side plate contact portion.

19. A turbo fan comprising:

a main plate having a disc shape and on which a rotational shaft is mounted;

a side plate provided to be separated from the main plate along an axial direction of the rotational shaft and having a ring shape with an opening at a center portion of the side plate; and a plurality of wings fixed between the main plate and the side plate along a circumferential direction of the main plate, wherein each wing of the plurality of wings includes a leading edge having a portion coming in contact with the side plate, a trailing edge, and a bended portion, which is bended in a reverse direction against a rotational direction of the wing between the portion of the leading edge of the wing coming in contact with the side plate and the trailing edge of the wing, and nearer to the portion of the leading edge of the wing coming into contact with the side plate than to the trailing edge.

20. The turbo fan of claim 19, wherein, for each wing of the plurality of wings:

the wing has a main plate contact portion at which the wing and the main plate initially come in contact with each other in a direction along the wing moving away from the leading edge, the main plate contact portion having a first curved shape having a first curvature variation, the wing has a side plate contact portion at which the wing and the side plate initially come in contact with each other in a direction along the wing moving away from the leading edge, the side plate contact portion having a second curved shape having a second curvature variation, and the bended portion is between the main plate contact portion and the side plate contact portion.

* * * * *